US012742369B1

(12) United States Patent
Craig et al.

(10) Patent No.: US 12,742,369 B1
(45) Date of Patent: Sep. 22, 2026

(54) MULTI-FUNCTIONING ELECTRIC CLEANING/FLOW SPLITTER/CIRCULATION SUB

(71) Applicant: Baker Hughes Oilfield Operations LLC, Houston, TX (US)

(72) Inventors: Steven Craig, Spring, TX (US); Bennie Jackson Lindsey, The Woodlands, TX (US); Nauman Mhaskar, Cypress, TX (US)

( * ) Notice: Subject to any disclaimer, the term of this patent is extended or adjusted under 35 U.S.C. 154(b) by 0 days.

(21) Appl. No.: 19/084,104

(22) Filed: Mar. 19, 2025

(51) Int. Cl.
*E21B 34/12* (2006.01)
*E21B 34/14* (2006.01)

(52) U.S. Cl.
CPC ..... *E21B 34/14* (2013.01); *E21B 2200/06* (2020.05)

(58) Field of Classification Search
CPC ..... E21B 34/066; E21B 34/14; E21B 34/12; E21B 2200/06; F16K 1/123; F16K 3/265
USPC ..... 251/343, 344
See application file for complete search history.

(56) References Cited

U.S. PATENT DOCUMENTS 5,896,924 A * 4/1999 Carmody ..... E21B 34/066 166/69
6,125,933 A * 10/2000 Ross ..... E21B 43/04 166/250.01
6,802,488 B1 * 10/2004 Patterson ..... F16K 1/123 251/267
7,168,493 B2 * 1/2007 Eddison ..... E21B 34/10 166/334.4
9,145,748 B1 9/2015 Meier et al.
11,319,786 B2 * 5/2022 Brown ..... F04B 53/06
11,591,902 B2 * 2/2023 Donderici ..... E21B 47/135
2001/0015275 A1 8/2001 Van et al.
2002/0005299 A1 1/2002 Estep et al.
2008/0135248 A1 * 6/2008 Talley ..... E21B 21/10 166/281
2012/0061095 A1 * 3/2012 Capderou ..... E21B 34/066 166/321
2016/0335464 A1 11/2016 Ownby et al.
2025/0198266 A1 * 6/2025 Duthie ..... E21B 17/023

OTHER PUBLICATIONS

WiCCS, "Wireless Cablehead and circulation system" brochure;;https://www.wins.no/cms/wp-content/uploads/2022/10/WICCS-One-Page-Flyer-29NOV21.pdf; 1 page.
Notification of Transmittal of the International Search Report and the Written Opinion of the International Searching Authority, or the Declaration; PCT/US2026/016260; Apr. 22, 2026; 10 pages.

* cited by examiner

*Primary Examiner* — Kenneth L Thompson
(74) *Attorney, Agent, or Firm* — Baker Hughes Company

(57) ABSTRACT

A work string performs a method of circulating a fluid in a borehole. The work string includes a sub includes a housing having a first section including a first flow bore and a second section including a second flow bore, a valve between the first flow bore and the second flow bore, at least one slot at a side of the housing in the first section, a sleeve movable within the first flow bore, the sleeve having an end proximate the valve and at least one opening along its side, and a linear actuator for moving the sleeve. The linear actuator places the sleeve in a position at which the end of the sleeve closes the valve and fluid flows from the first flow bore to a region outside of the housing through the at least one opening.

13 Claims, 14 Drawing Sheets

MULTI-FUNCTIONING ELECTRIC CLEANING/FLOW SPLITTER/CIRCULATION SUB

BACKGROUND

In the resource recovery and fluid sequestration industries, a work string is deployed in a borehole. Fluid can be injected into the borehole for various operations, such as clean out, stimulation, etc. Each operation generally involves a dedicated sub. Thus, the work string has to carry multiple subs downhole to perform these operations, leading to bulky work strings and costly operations. Therefore, there is a need for a sub that can perform multiple functions downhole.

SUMMARY

Disclosed herein is a work string. The work string includes a housing of a sub of the work string, the housing having a first section including a first flow bore and a second section including a second flow bore, a valve between the first flow bore and the second flow bore, at least one slot at a side of the housing in the first section, a sleeve movable within the first flow bore, the sleeve having a an end proximate the valve and at least one opening along its side, and a linear actuator for moving the sleeve to a position at which the end of the sleeve closes the valve and fluid flows from the first flow bore to a region outside of the housing through the at least one opening.

Also disclosed herein is a method of circulating a fluid in a borehole. A work string is disposed in the borehole. The work string including a sub includes a housing having a first section including a first flow bore and a second section including a second flow bore, a valve between the first flow bore and the second flow bore, at least one slot at a side of the housing in the first section, a sleeve movable within the first flow bore, the sleeve having an end proximate the valve and at least one opening along its side, and a linear actuator for moving the sleeve. The linear actuator is operated to place the sleeve in a position at which the end of the sleeve closes the valve and fluid flows from the first flow bore to a region outside of the housing through the at least one opening.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
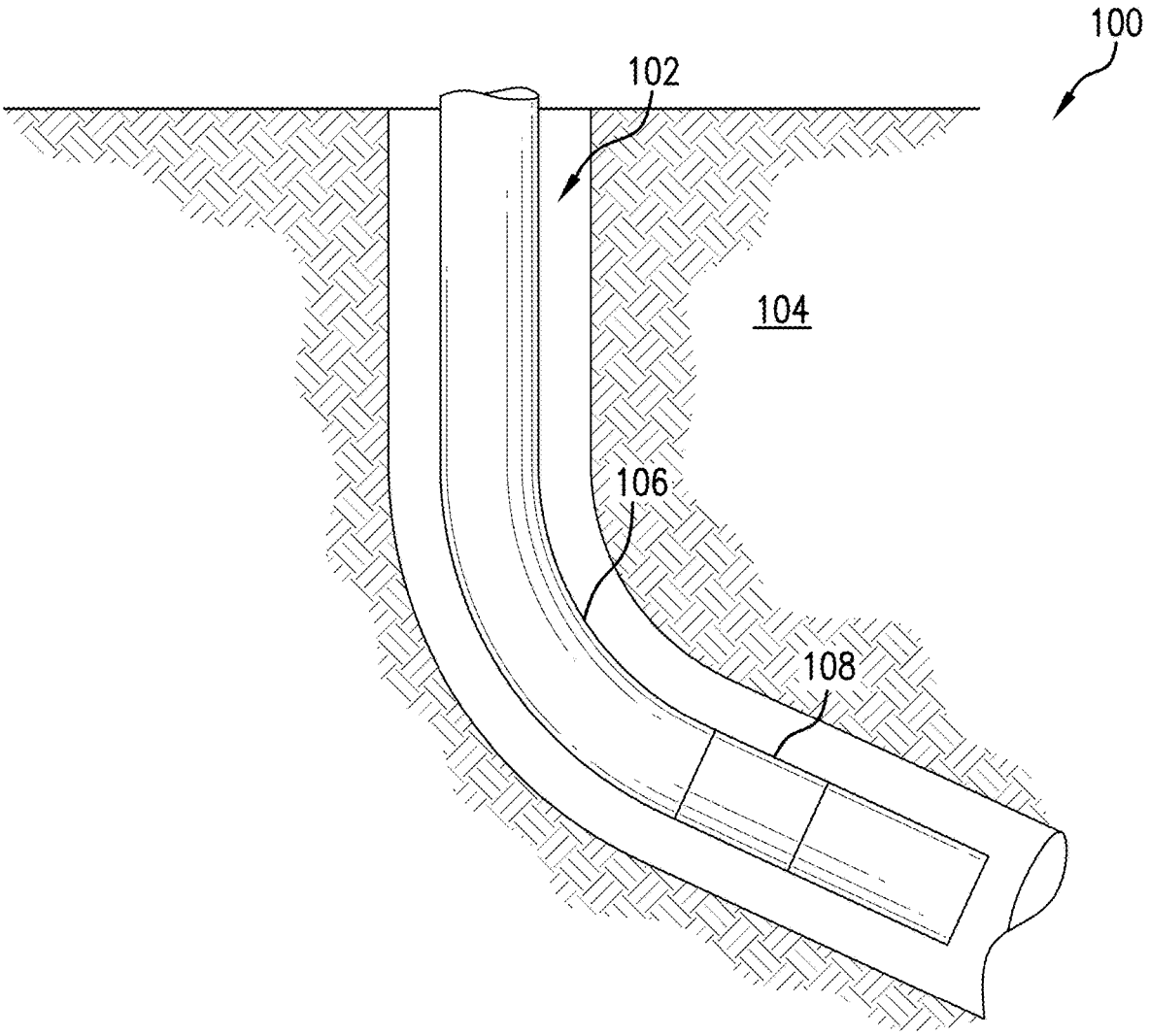
FIG. 1 depicts an illustrative borehole system.

Referring to FIG. 1, a borehole system 100 is illustrated. The borehole system 100 comprises a borehole 102 in a subsurface formation 104. A string 106 is disposed within the borehole 102. A sub 108 as disclosed herein is disposed within or as a part of the string 106. A fluid is circulated downhole through an interior of the string 106. In various embodiments, the sub 108 controls flow of the fluid into a lower section of the string 106 and/or into the borehole 102, as discussed herein.

Figure 2:
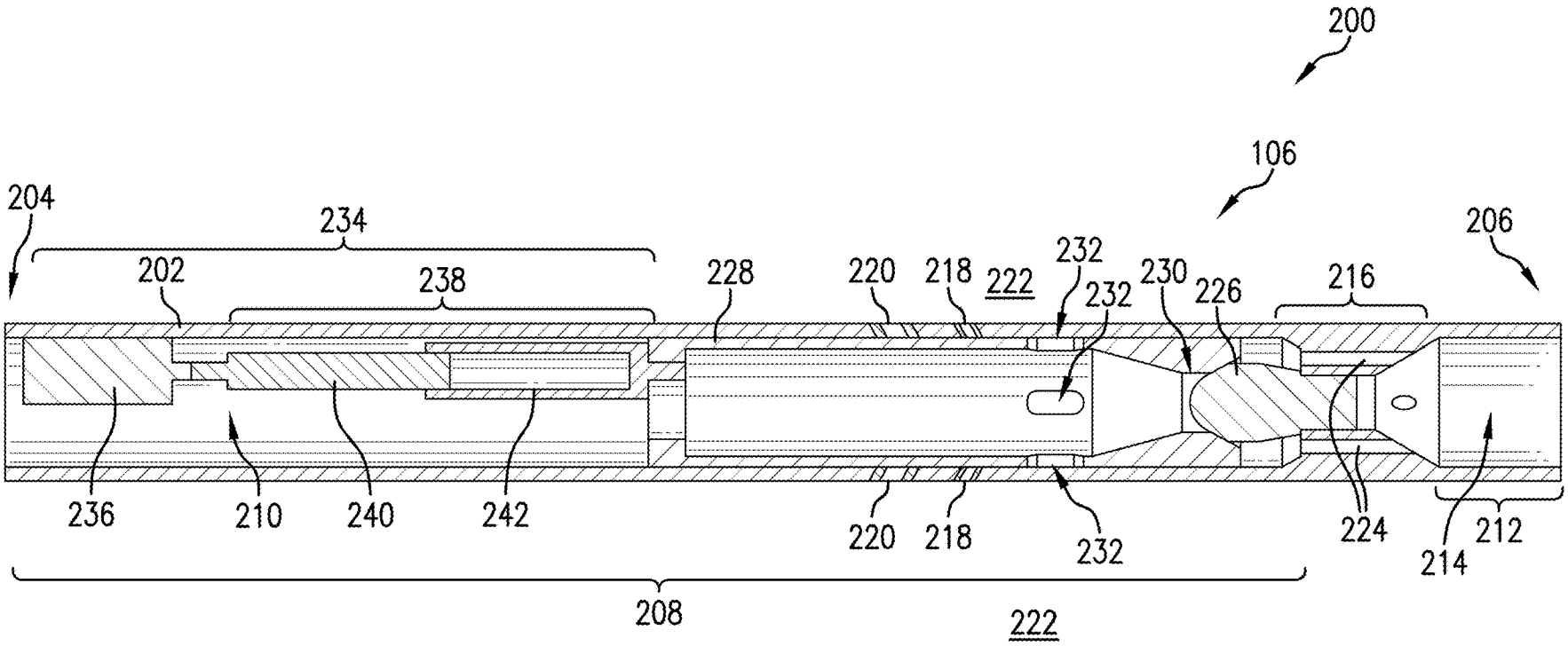
FIG. 2 is a cross-sectional view of a sub of the borehole system in a first configuration in which no flow is occurring.

FIG. 2 is a cross-sectional view 200 of the sub 108, in an illustrative embodiment. The sub 108 includes a housing 202 extending from a first end 204 to a second end 206. In general, the first end 204 is located at an uphole end of the string 106 and the second end 206 is located at a downhole end of the string 106. The housing 202 includes a first section 208 having a first flow bore 210 and a second section 212 having a second flow bore 214 aligned with the first flow bore 210 along an axis of the housing 202. A valve 216 separates the first flow bore 210 from the second flow bore 214. The first section 208 includes at least one nozzle in a side surface of the housing 202. Each nozzle provides a passage through the side of the housing 202 allowing fluid to flow between the first flow bore 210 and a volume or region 222 outside of the housing 202 (i.e., the borehole 102). A first set of nozzles 218 are shown at a first axial location and a second set of nozzles 220 are shown at a second axial location, for illustrative purposes. The first set of nozzles 218 includes four nozzles angularly separated by 90 degrees from each other along the housing 202. The second set of nozzles 220 also includes four nozzles angularly separated by 90 degrees from each other along the housing 202.

The first set of nozzles 218 includes nozzles having an upward angle (fluid is ejected along a trajectory having a component in the direction of the first end) and having a swirl orientation (the trajectory has a circumferential component) to optimize solids fluidization. The second set of nozzles 220 has nozzles with the same or similar orientation. Although two sets of nozzles are shown or illustrative purposes, in other embodiments, the first section 208 can include more than two sets of nozzles, with each set of nozzles in transverse planes at different axial locations along the housing 202. In various embodiments, one or more nozzles can be replaced by holes or slots in the surface of the first section 208 of the housing 202.

The valve 216 includes at least one fluid channel 224 between the first flow bore 210 and the second flow bore 214 and a plug 226 that extends from the valve 216 into the first flow bore 210. The plug 226 can be any suitable shape, such as conical, bulbous, etc. The plug 226 has a selected plug diameter within a plane transvers to the longitudinal axis of the housing 202. The plug 226 can be centrally located within the housing 202 (i.e., in the radial center) The at least one fluid channel 224 can be a plurality of fluid channels. The plurality of fluid channels can be arranged eccentrically around the plug in a suitable arrangement. Alternatively, the plug 226 can be eccentrically positioned within the housing 202 and the at least one fluid channel 224 can be located either eccentrically within the housing 202 or at the radial center of the housing 202.

A sleeve 228 is disposed in the first flow bore 210 and is configured to move or slide within the first flow bore 210. The sleeve 228 is a hollow cylindrical device or tube that includes a seat 230 at an end proximate the valve 216. The seat 230 is a region of sleeve 228 having a reduced diameter. The seat 230 has an inner diameter that is less than the selected plug diameter. The sleeve 228 can be mated to the valve 216 to close the at least one fluid channel 224. Mating the sleeve 228 to the valve 216 involves moving the sleeve 228 toward the second end 206 of the housing 202 until the seat 230 mates on the plug 226, causing the plug 226 to sit in the seat 230 to form a seal that prevents fluid from flowing out of the sleeve 228 through the seat 230.

A linear actuator 234 controls movement of the sleeve 228 axially within the first flow bore 210. The linear actuator 234 includes a motor 236 and a ball screw 238. In other embodiments, the linear actuator 234 can include a lead screw. The ball screw 238 includes a screw shaft 240 extending along the axis of the housing 202 and a nut 242. The screw shaft 240 is connected to the motor 236 and the nut 242 is connected to the sleeve 228. The motor 236 rotates the screw shaft 240, which rotates within the nut 242. The nut 242 is thread on its internal surface and the rotating of the screw shaft 240 therefore moves the nut 242 (and sleeve 228) along the axis of the housing 202. The direction of rotation of the screw shaft 240 determines the direction of motion of the nut 242 and sleeve 228. Thus, the motor 236 controls the axial motion of the sleeve 228 via the ball screw 238. The motor 236 can be an electrical motor, an electro-hydraulic motor or other suitable motor that can be fit into the first flow bore 210.

The sleeve 228 includes at least one opening 232 on its side surface. For illustrative purposes, the at least one opening 232 includes four openings that are separated from each other by 90 degrees along the side of the sleeve 228. Each opening is angularly aligned with a respective one of the nozzles. In other words, an opening in the sleeve is at a same azimuthal location of the housing as a corresponding nozzle.

FIG. 2 shows the sub 108 in a first configuration in which no flow is occurring. The sleeve 228 is moved to the extent of it range in the direction of the second end 206. As a result, the seat 230 of the sleeve 228 is mated to the plug 226. The plug 226 is thus seated at the seat 230 and forms a seal that prevents flow of a fluid out of the first flow bore 210, through the valve 216, and into the second flow bore 214. Simultaneously, in this first configuration, the sleeve 228 covers all of the nozzles in the housing 202. In other words, the at least one opening 232 is not at the same axial location as either the first set of nozzles 218 or the second set of nozzles 220. In this configuration, fluid in the first flow bore 210 is prevented from flowing into the second flow bore 214 and also is prevented from flowing out of the first flow bore 210 into the region 222.

Figure 3:
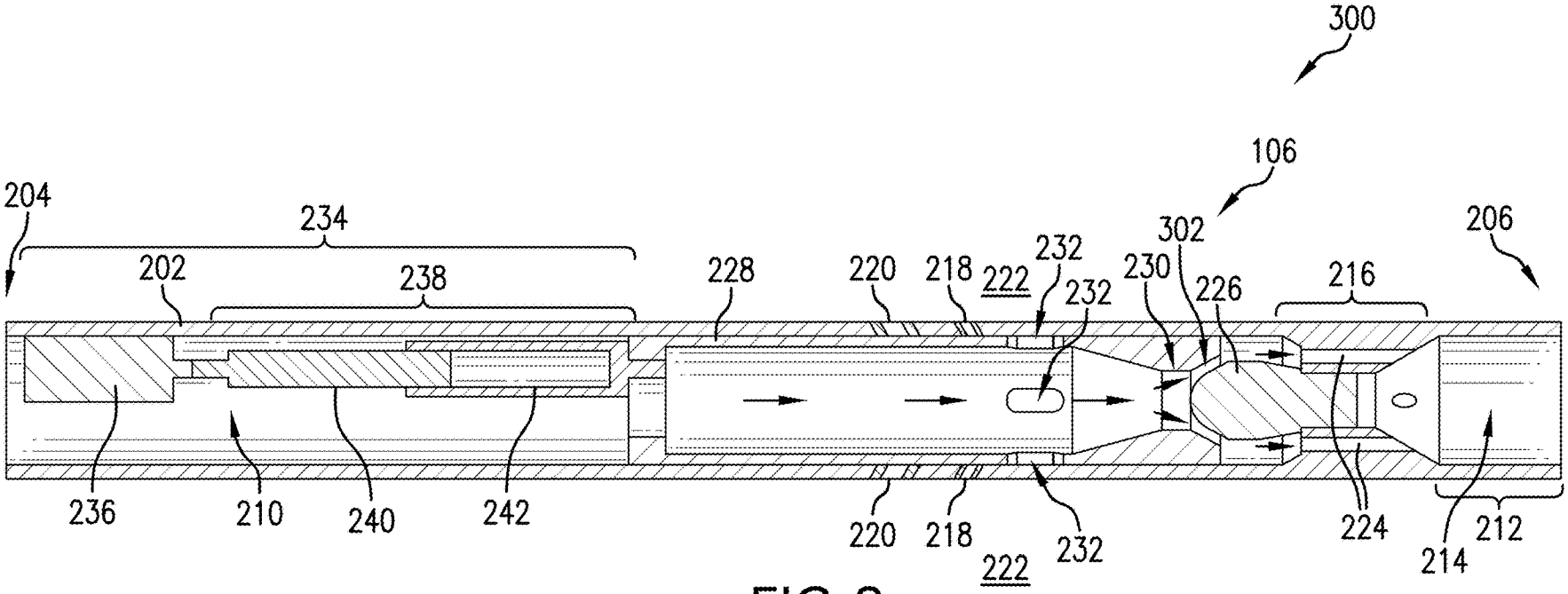
FIG. 3 shows the sub in a second configuration in which flow occurs between the first flow bore and the second flow bore.

FIG. 3 shows the sub 108 in a second configuration 300 in which flow occurs between the first flow bore 210 and the second flow bore 214. The sleeve 228 has been moved toward the first end with respect to its position in FIG. 2, thereby creating a gap 302 between the seat 230 and the plug 226. However, the at least one opening 232 is still at a different axial location as each of the first set of nozzles 218 and the second set of nozzles 220. Thus, fluid is able to flow between the first flow bore 210 and the second flow bore 214, but no fluid flows from the first flow bore 210 directly into the region 222 of the borehole 102.

Figure 4:
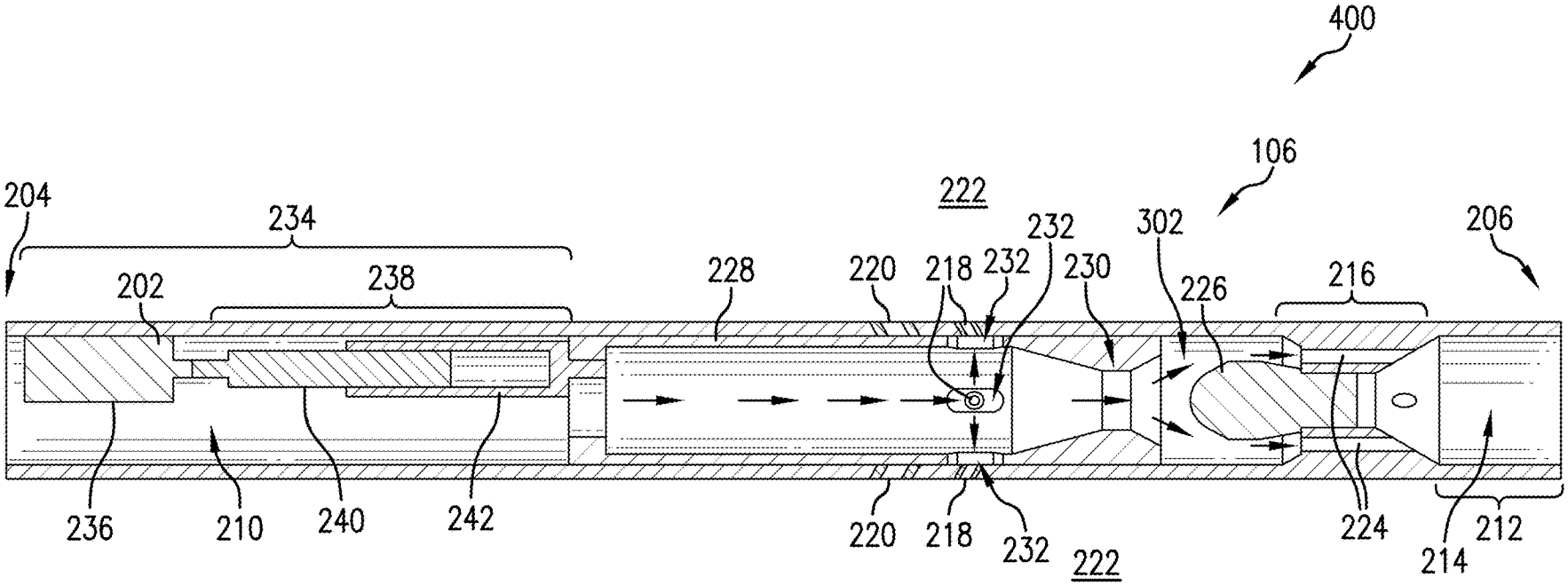
FIG. 4 shows the sub in a third configuration.

FIG. 4 shows the sub 108 in a third configuration 400. The sleeve 228 is moved even further toward the first end 204, thereby opening the gap 302 and allowing for greater fluid flow between the first flow bore 210 and the second flow bore 214. In addition, the sleeve is positioned such that the at least one opening 232 is at a same axial location as the first set of nozzles 218. Thus, fluid is also able to flow out of the first flow bore 210 and into the region 222 via the first set of nozzles 218.

Figure 5:
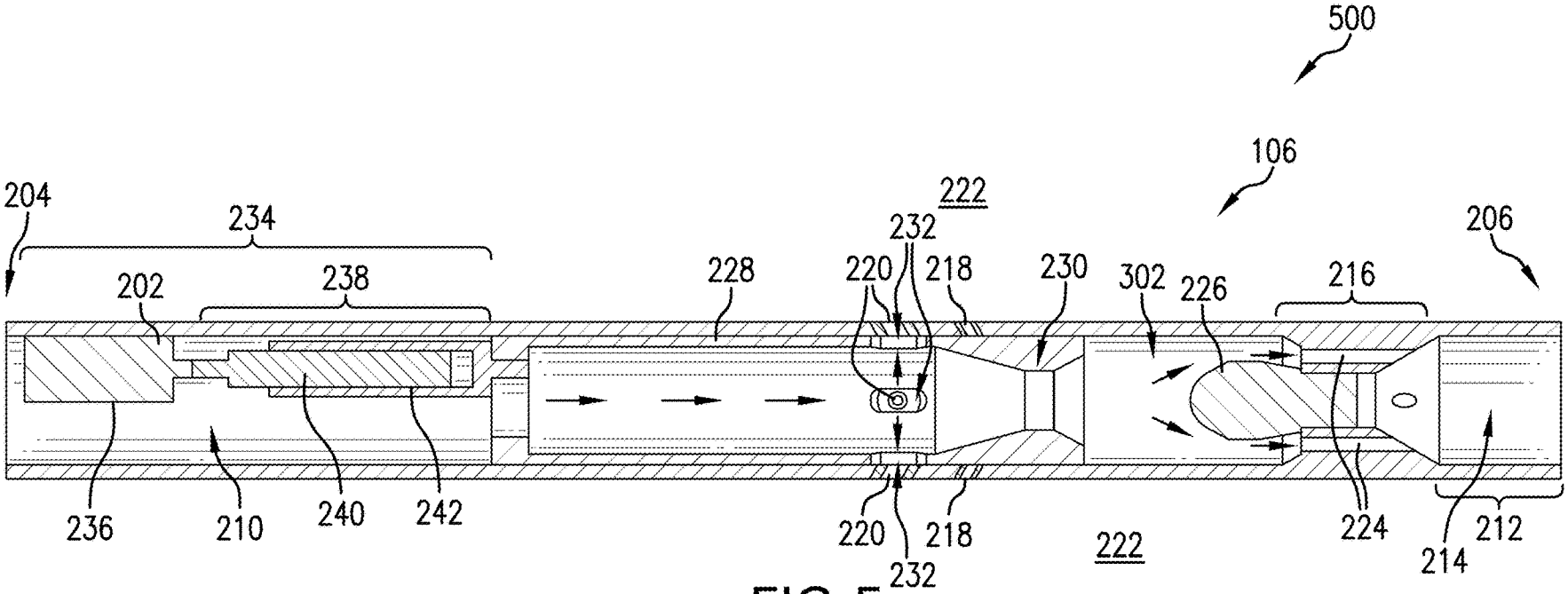
FIG. 5 shows the sub in a fourth configuration.

FIG. 5 shows the sub 108 in a fourth configuration 500. The sleeve 228 has been moved even further toward the first end 204, thereby opening the gap 302 even wider and allowing for greater fluid flow between the first flow bore 210 and the second flow bore 214. In addition, the sleeve 228 is positioned such that the at least one opening 232 is at a same axial location as the second set of nozzles 220. Thus, fluid is able to flow out of the first flow bore and into the region 222 via the second set of nozzles 220.

A nozzle of the first set of nozzles 218 and a nozzle of the second set of nozzles 220 can have different sizes or diameters. For illustrative purposes, the diameter associated with the second set of nozzles 220 is greater than the diameter associated with the first set of nozzles 218. Thus, in the fourth configuration, the sleeve 228 allows a largest volume of fluid flow into the second flow bore and a greater flow of fluid into the region 222. The specifications (e.g., diameters) of the first set of nozzles 218 and the second set of nozzles 220 can be decided when the sub 108 is at a surface location and the nozzles can be added before deploying the sub 108 downhole and/or switched out for other nozzles as required by downhole conditions.

Figure 6:
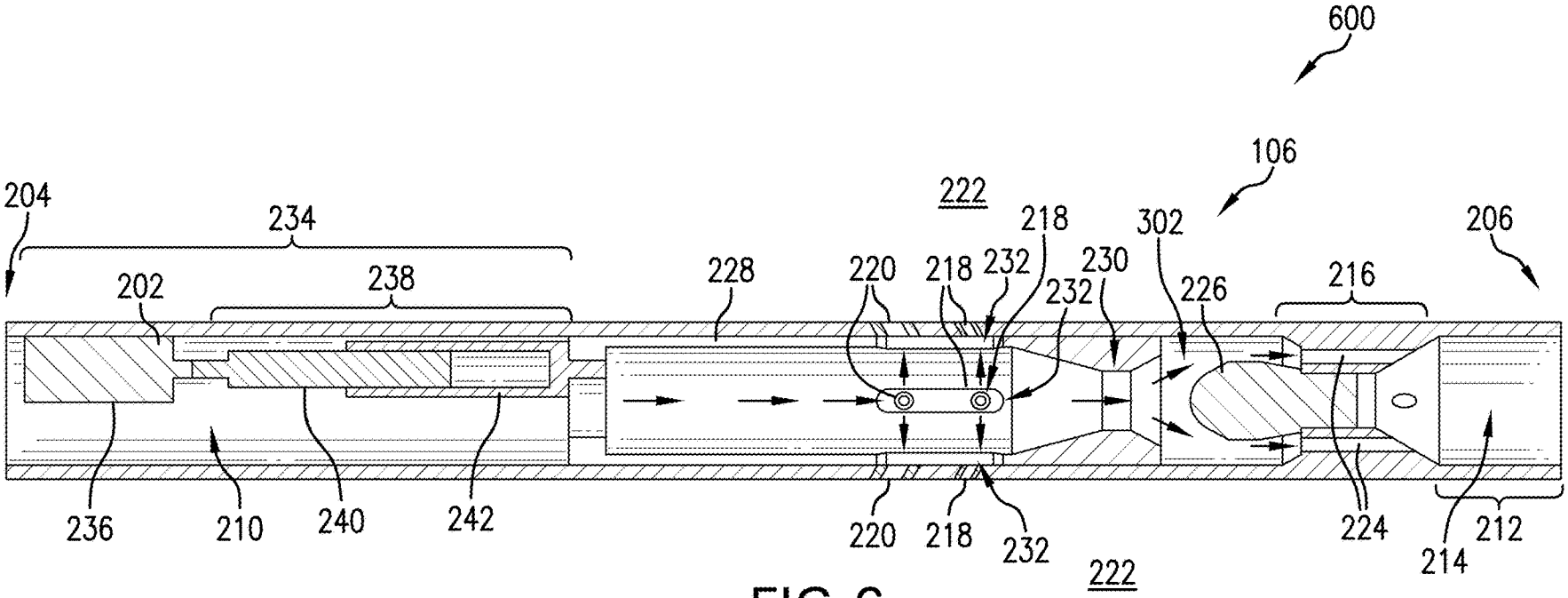
FIG. 6 shows the sub having an alternative configuration for the at least one opening of the sleeve.

FIG. 6 shows the sub 108 having an alternative configuration for the at least one opening 232 of the sleeve 228. The at least one opening 232 extends longitudinally along the sleeve 228 to a length that permits both the first set of nozzles 218 and the second set of nozzles 220 to be open at the same when the sleeve is at a selected position within the housing 202. The length of the at least one opening 232 is also such that the sleeve 228 can be placed in a position to open only the first set of nozzles 218 or only the second set of nozzles 220. For a housing 202 that includes more than two sets of nozzles, the sleeve 228 can be moved such that the at least one opening 232 opens either a single set of nozzles or multiple sets of nozzles.

Figure 7:
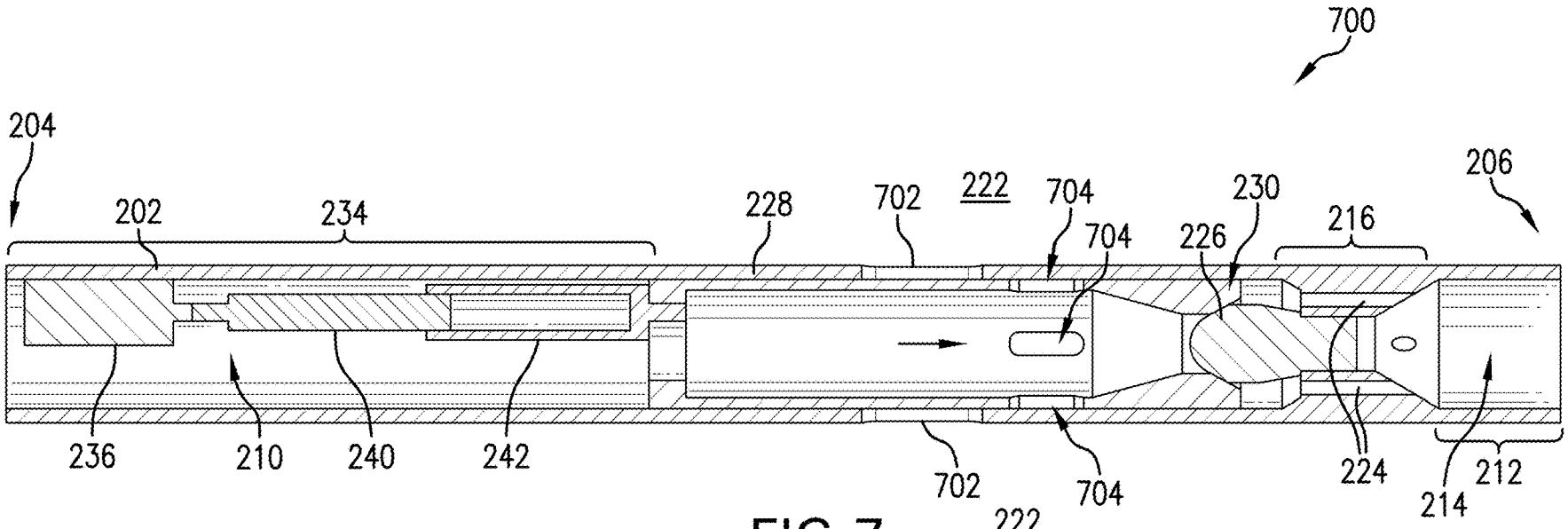
FIG. 7 shows a second embodiment of the sub in a first configuration in which no flow is occurring.

FIG. 7 shows a second embodiment of the sub 108 in a first configuration 700 in which no flow is occurring. The housing 202 of the sub 108 includes a set of slots 702, each slot having a selected length along the longitudinal axis of the housing 202 and a selected width around the circumference of the housing 202. The selected length is greater than the second width, resulting in a generally rounded rectangular slot with its longer dimension (i.e., length) extending along the axis of the housing 202. The sleeve 228 of the sub 108 includes a set of openings 704. Each opening corresponds to a slot of the set of slots and is located at a same azimuthal location as the corresponding slot. Each opening also has dimensions similar to the dimensions of its corresponding slot. In the first configuration, the sleeve 228 is moved to the extent of it range in the direction of the second end 206, thereby mating the seat 230 of the sleeve 228 to the plug 226. The plug 226 is thus seated at the seat 230 and forms a seal that prevents flow of a fluid from the first flow bore 210 to the second flow bore 214. Simultaneously, in this first configuration, the sleeve 228 covers all of the nozzles in the housing 202. In other words, the set of openings 704 is not at the same axial location as the set of slots 702. Thus, fluid in the first flow bore 210 is also prevented from flowing into the region 222.

Figure 8:
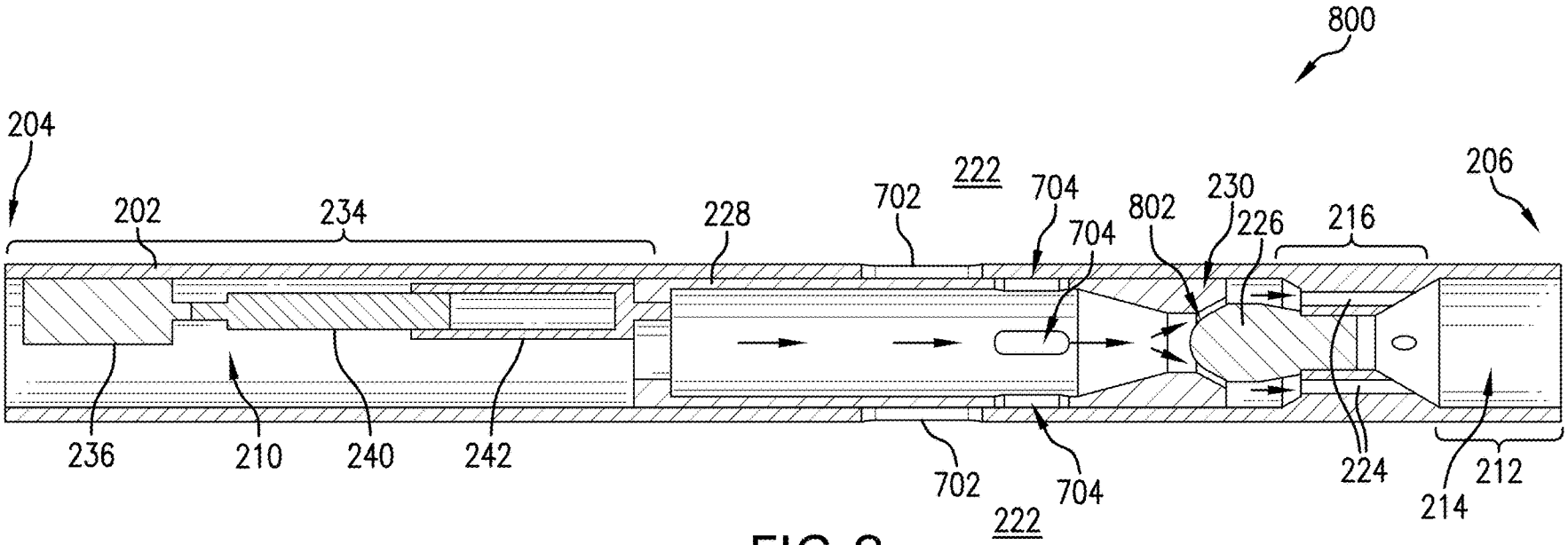
FIG. 8 shows the second embodiment of the sub in a second configuration.

FIG. 8 shows the second embodiment of the sub 108 in a second configuration 800. The sleeve 228 has been moved toward the first end with respect to its position in FIG. 7, thereby creating a gap 802 between the seat 230 and the plug 226. However, the set of openings 704 is still at a different axial position than the set of slots 702. Thus, fluid is able to flow between the first flow bore 210 and the second flow bore 214, but no fluid flows from the first flow bore 210 directly into region 222 of the borehole 102.

Figure 9:
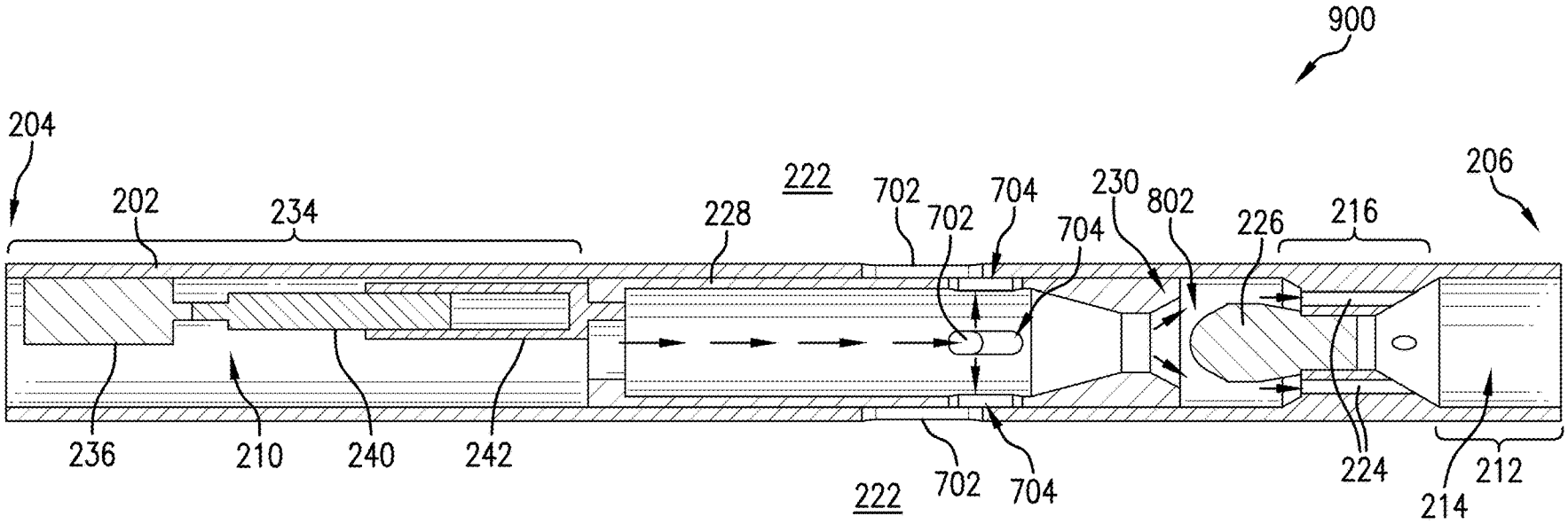
FIG. 9 shows the second embodiment of the sub in a third configuration.

FIG. 9 shows the second embodiment of the sub 108 in a third configuration 900. The sleeve 228 has been moved even further toward the first end 204, thereby increasing a size of the gap 302 and allowing for greater fluid flow between the first flow bore 210 and the second flow bore 214. In addition, the sleeve is at an axial position such that the set of openings 704 partially overlaps the set of slots 702. Thus, fluid is also able to flow out of the first flow bore 210 and into the region 222 via the set of slots 702.

Figure 10:
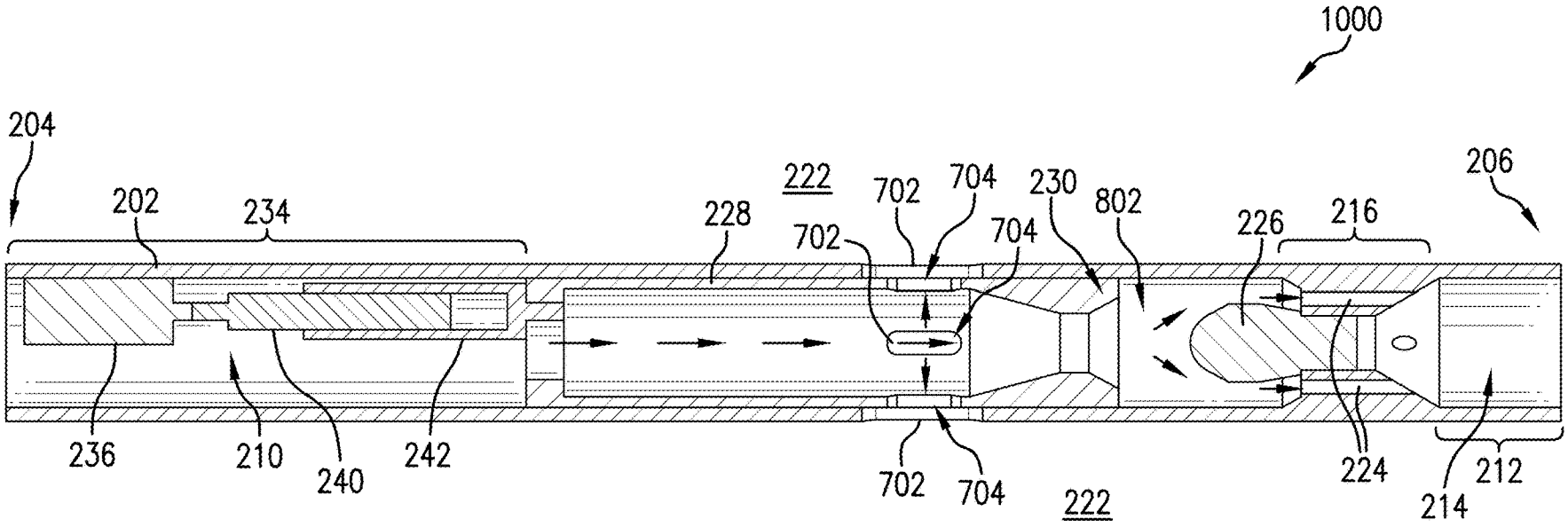
FIG. 10 shows the second embodiment of the sub in a fourth configuration.

FIG. 10 shows the second embodiment of the sub 108 in a fourth configuration 1000. The sleeve 228 has been moved even further toward the first end 204, thereby further increasing the size of the gap 302 and allowing for greater fluid flow between the first flow bore 210 and the second flow bore 214. In addition, the sleeve 228 is at an axial position such that the set of openings 704 fully overlaps the set of slots 702. Thus, fluid is able to flow out of the first flow bore and into region 222 via the set of slots 702. As seen by comparison of FIG. 9 and FIG. 10, the degree of overlap of the set of openings 704 and the set of slots 702 can be set to a desired amount, thereby controlling an amount of fluid that flows in the region 222.

Figure 11:
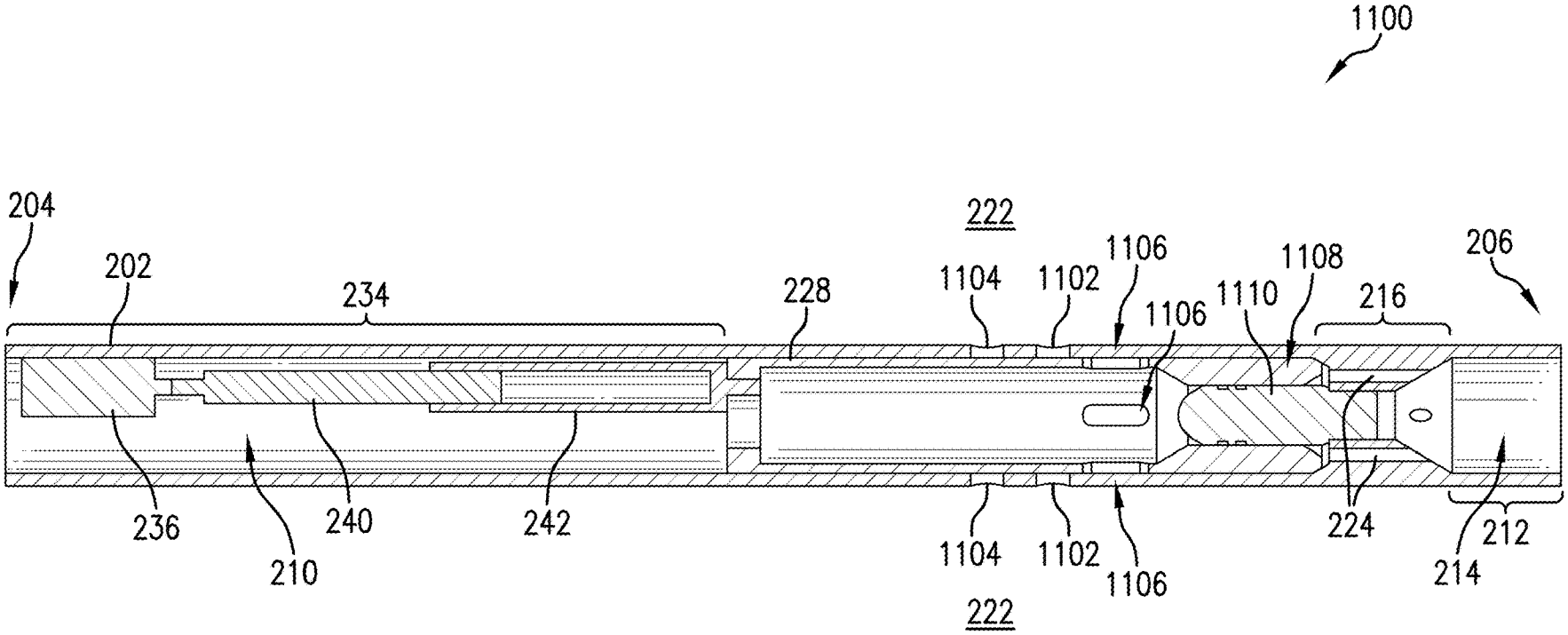
FIG. 11 shows a third embodiment of the sub in a first configuration in which no flow is occurring.

FIG. 11 shows a third embodiment of the sub 108 in a first configuration 1100 in which no flow is occurring. The housing 202 of the sub 108 includes a first set of slots 1102 and a second set of slots 1104 axially displaced from the first set of slots 1102. The first set of slots 1102 is closer to the valve 216 that the second set of slots 1104. The slots in the housing 202 are substantially circular. The sleeve 228 of the sub 108 includes a set of openings 1106. The openings are substantially extended in the axial direction, with a length of the opening greater a width of the opening. Each opening corresponds to a slot of the first set of slots 1102 and a slot of the second set of slots 1104 and is located at a same azimuthal location as its corresponding slots.

The valve 216 of the sub 108 includes at least one fluid channel 224 between the first flow bore 210 and the second flow bore 214 and a plug 1110 that extends from the valve 216 into the first flow bore 210. The plug 1110 has a generally cylindrical shape having plug length along the longitudinal axis.

A sleeve 228 is disposed in the first flow bore 210 and is configured to move or slide within the first flow bore 210. The sleeve 228 includes a seat 1108 at an end proximate the valve 216. The seat 230 has an extended bore into which the plug 1110 can extend. The extended bore has an inner diameter that allows the plug 1110 to fit snugly within the bore. The sleeve 228 can be mated to the valve 216 to close the valve 216. Mating the sleeve 228 to the valve 216 involves moving the sleeve 228 toward the second end 206 of the housing 202. With the sleeve 228 at its furthest position toward the second end, the plug 226 extends into the bore of the seat 230 along an entirety of the first longitudinal length, thereby forming a seal. It is clear that, due to the length of the plug 226, the plug 226 remains at least partially mated to the sleeve 228 over an extended travel distance of the sleeve that corresponds to the length of the plug 226.

In the first configuration, the sleeve 228 covers all of the slots in the housing 202. In other words, the at set of openings 1106 is not at the same axial location as either the first set of slots 1102 or the second set of slots 1104. In this first configuration, fluid in the first flow bore 210 is prevented from flowing into the second flow bore 214 and also is prevented from flowing out of the first flow bore 210 into the region 222.

Figure 12:
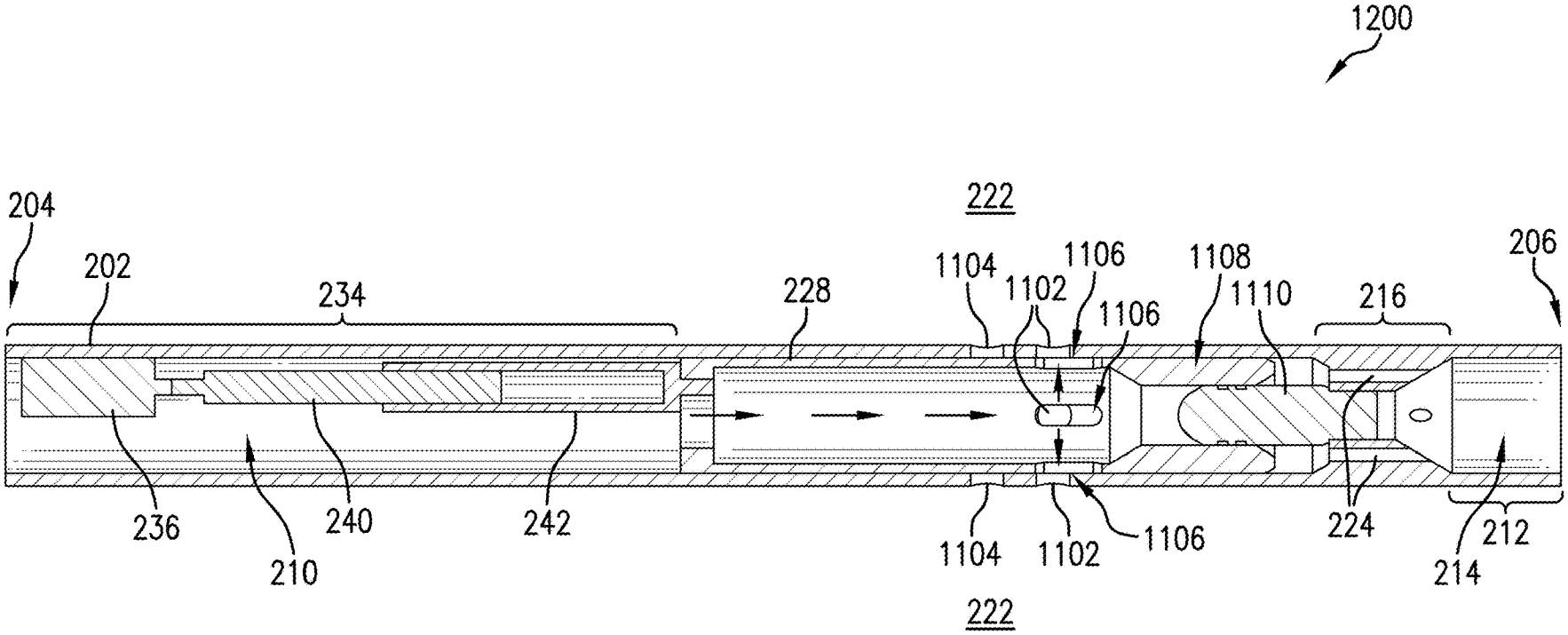
FIG. 12 shows the third embodiment of the sub in a second configuration.

FIG. 12 shows the third embodiment of the sub 108 in a second configuration 1200. The sleeve 228 has been moved toward the first end 204 with respect to its position in FIG. 11. In this configuration, the plug 1110 is still partially disposed within the seat 1108. However, the set of openings 1106 overlaps the first set of slots 1102. As a result, no fluid flows from the first flow bore 210 directly into the borehole 102, but fluid flows from the first flow bore 210 to the region 222 via the first set of slots 1102.

Figure 13:
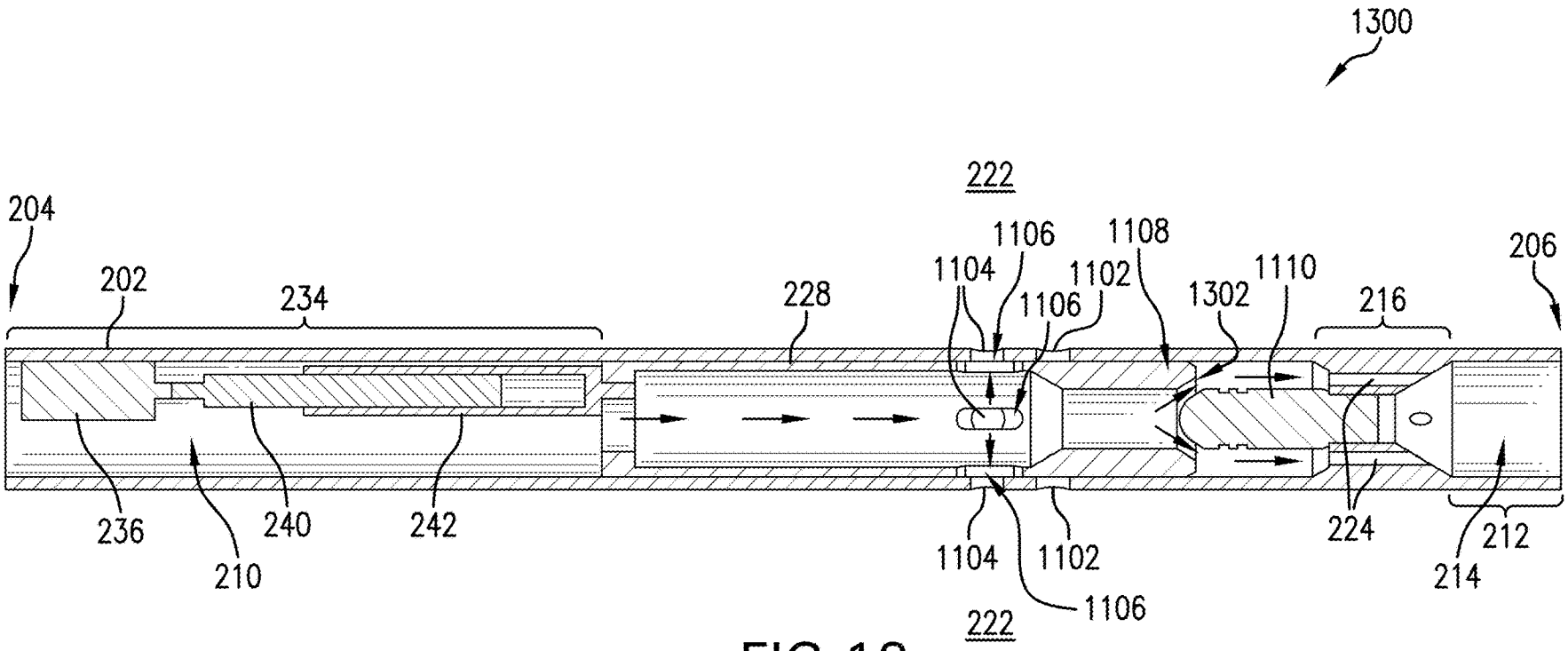
FIG. 13 shows the third embodiment of the sub in a third configuration.

FIG. 13 shows the third embodiment of the sub 108 in a third configuration 1300. The sleeve 228 has been moved toward the first end 204 with respect to its position in FIG. 12. In this configuration, the plug 1110 is removed from the seat 1108, thereby creating a gap 1302. Also, the set of openings 1106 overlaps the second set of slots 1104. As a result, fluid flows from the first flow bore 210 directly into the second flow bore 214 and also fluid flows from the first flow bore 210 to the region 222 via the second set of slots 1104.

Figure 14:
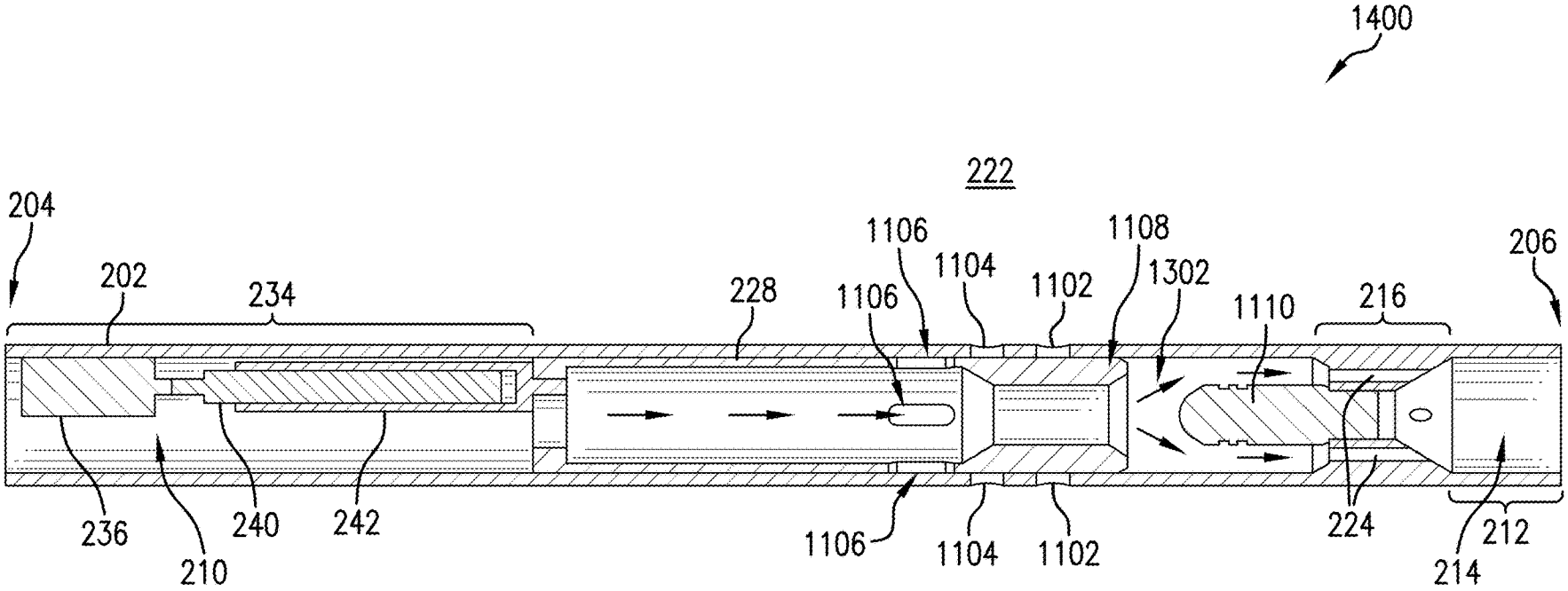
FIG. 14 shows the third embodiment of the sub in a fourth configuration 1400.

FIG. 14 shows the third embodiment of the sub 108 in a fourth configuration 1400. The sleeve 228 has been moved toward the first end 204 with respect to its position in FIG. 13. In this configuration, the gap 1302 between the plug 1110 and the seat 1108 is increased and the set of openings 1106 no longer overlaps either the first set of slots 1104 or the second set of slots 1104. As a result, fluid flows from the first flow bore 210 directly into the second flow bore 214, but no fluid flows from the first flow bore 210 to the region 222.

Set forth below are some embodiments of the foregoing disclosure:

Embodiment 1. A work string. The work string includes a housing of a sub of the work string, the housing having a first section including a first flow bore and a second section including a second flow bore, a valve between the first flow bore and the second flow bore, at least one slot at a side of the housing in the first section, a sleeve movable within the first flow bore, the sleeve having a an end proximate the valve and at least one opening along its side, and a linear actuator for moving the sleeve to a position at which the end of the sleeve closes the valve and fluid flows from the first flow bore to a region outside of the housing through the at least one opening.

Embodiment 2. The work string of any prior embodiment, wherein the linear actuator is an electrical motor disposed within the first flow bore.

Embodiment 3. The work string of any prior embodiment, wherein the valve includes a plug extending into the first flow bore and the sleeve includes a seat, wherein the plug has a plug length and the seat is mated to the plug to close the valve over an extended travel distance of the sleeve.

Embodiment 4. The work string of any prior embodiment, wherein one of: (i) the plug is located radially central within the housing and at least one fluid channel located eccentrically from the plug to connect the first flow bore and the second flow bore; (ii) the plug is located eccentrically within the housing and the at least one fluid channel is located eccentrically within the housing; and (iii) the plug is located eccentrically within the housing and the at least one fluid channel is located radially central within the housing.

Embodiment 5. The work string of any prior embodiment, wherein the at least one slot includes a first set of slots at a first axial location of the housing and a second set of slots at a second axial location of the housing, wherein the first axial location is closer to the valve than the second axial location, wherein the linear actuator is configured to place the sleeve in another position such that one of: (i) the first set of slots is open, the second set of slots is closed, and the valve is closed; and (ii) the first set of slots is closed, the second set of slots is open and the valve is open; and (iii) the first set of slots is closed, the second set of slots is closed and the valve is open.

Embodiment 6. The work string of any prior embodiment, wherein the at least one slots includes a first set of slots and a second set of slots axially displaced form the first set of slots and the linear actuator is configured to place the sleeve at another position such that the at least one opening opens both the first set of slots and the second set of slots.

Embodiment 7. The work string of any prior embodiment, wherein the linear actuator is further configured to move the sleeve to another position such that one of: (i) the at least one opening partially overlaps the at least one slot; and (ii) the at least one opening fully overlaps the at least one slot.

Embodiment 8. The work string of any prior embodiment, wherein the at least one opening is a generally rounded rectangular slot with its longer dimension extending along an axis of the housing.

Embodiment 9. A method of circulating a fluid in a borehole. A work string is disposed in the borehole. The work string includes a sub with a housing having a first section including a first flow bore and a second section including a second flow bore, a valve between the first flow bore and the second flow bore, at least one slot at a side of the housing in the first section, a sleeve movable within the first flow bore, the sleeve having an end proximate the valve and at least one opening along its side, and a linear actuator for moving the sleeve. The linear actuator is operated to place the sleeve in a position at which the end of the sleeve closes the valve and fluid flows from the first flow bore to a region outside of the housing through the at least one opening.

Embodiment 10. The method of any prior embodiment, further comprising operating the linear actuator using an electrical motor disposed within the first flow bore.

Embodiment 11. The method of any prior embodiment, wherein the valve includes a plug extending into the first flow bore and the end of the sleeve includes a seat, wherein the plug has a plug length and the seat is mated to the plug to close the valve over an extended travel distance of the sleeve.

Embodiment 12. The method of any prior embodiment, wherein one of: (ii) the plug is located radially central within the housing and at least one fluid channel located eccentrically from the plug to connect the first flow bore and the second flow bore; (ii) the plug is located eccentrically within the housing and the at least one fluid channel is located eccentrically within the housing; and (iii) the plug is located eccentrically within the housing and the at least one fluid channel is located radially central within the housing.

Embodiment 13. The method of any prior embodiment, wherein the at least one slot includes a first set of slots at a first axial location of the housing and a second set of slots at a second axial location of the housing, wherein the first axial location is closer to the valve than the second axial location, further comprising operating the linear actuator to place the sleeve in another position such that one of: (i) the first set of slots is open, the second set of slots is closed, and the valve is closed; and (ii) the first set of slots is closed, the second set of slots is open and the valve is open; and (iii) the first set of slots is closed, the second set of slots is closed and the valve is open.

Embodiment 14. The method of any prior embodiment, wherein the at least one slots includes a first set of slots and a second set of slots axially displaced form the first set of nozzles, further comprising operating the linear actuator to place the sleeve at another position such that the at least one opening opens both the first set of slots and the second set of slots.

Embodiment 15. The method of any prior embodiment, further comprising operating the linear actuator to move the sleeve to another position such that one of: (i) the at least one opening partially overlaps the at least one slot; and (ii) the at least one opening fully overlaps the at least one slot.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A work string, comprising:

a housing of a sub of the work string, the housing having a first section including a first flow bore and a second section including a second flow bore;

a valve between the first flow bore and the second flow bore;

at least one slot at a side of the housing in the first section;

a sleeve movable within the first flow bore, the sleeve having an end proximate the valve and at least one opening along its side; and an electrical motor di posed within the first flow bore for moving the sleeve to a position at which the end of the sleeve closes the valve and fluid flows from the first flow bore to a region outside of the housing through the at least one opening.

2. The work string of claim 1, wherein the valve includes a plug extending into the first flow bore and the sleeve includes a seat, wherein the plug has a plug length and the seat is mated to the plug to close the valve over an extended travel distance of the sleeve.

3. The work string of claim 2, wherein one of: (i) the plug is located radially central within the housing and at least one fluid channel located eccentrically from the plug to connect the first flow bore and the second flow bore; (ii) the plug is located eccentrically within the housing and the at least one fluid channel is located eccentrically within the housing; and (iii) the plug is located eccentrically within the housing and the at least one fluid channel is located radially central within the housing.

4. The work string of claim 1, wherein the at least one slot includes a first set of slots at a first axial location of the housing and a second set of slots at a second axial location of the housing, wherein the first axial location is closer to the valve than the second axial location, wherein the linear actuator is configured to place the sleeve in another position such that one of: (i) the first set of slots is open, the second set of slots is closed, and the valve is closed; and (ii) the first set of slots is closed, the second set of slots is open and the valve is open; and (iii) the first set of slots is closed, the second set of slots is closed and the valve is open.

5. The work string of claim 1, wherein the at least one slots includes a first set of slots and a second set of slots axially displaced form the first set of slots and the linear actuator is configured to place the sleeve at another position such that the at least one opening opens both the first set of slots and the second set of slots.

6. The work string of claim 1, wherein the linear actuator is further configured to move the sleeve to another position such that one of: (i) the at least one opening partially overlaps the at least one slot; and (ii) the at least one opening fully overlaps the at least one slot.

7. The work string of claim 1, wherein the at least one opening is a generally rounded rectangular slot having a shorter dimension and a longer dimension, the longer dimension extending along an axis of the housing.

8. A method of circulating a fluid in a borehole, comprising:

disposing a work string in the borehole, the work string including a sub comprising:

a housing having a first section including a first flow bore and a second section including a second flow bore;

a valve between the first flow bore and the second flow bore;

at least one slot at a side of the housing in the first section;

a sleeve movable within the first flow bore, the sleeve having an end proximate the valve and at least one opening along its side;

a linear actuator for moving the sleeve; and operating the linear actuator using an electrical motor disposed within the first flow bore to place the sleeve in a position at which the end of the sleeve closes the valve and fluid flows from the first flow bore to a region outside of the housing through the at least one opening.

9. The method of claim 8, wherein the valve includes a plug extending into the first flow bore and the end of the sleeve includes a seat, wherein the plug has a plug length and the seat is mated to the plug to close the valve over an extended travel distance of the sleeve.

10. The method of claim 9, wherein one of: (ii) the plug is located radially central within the housing and at least one fluid channel located eccentrically from the plug to connect the first flow bore and the second flow bore; (ii) the plug is located eccentrically within the housing and the at least one fluid channel is located eccentrically within the housing; and (iii) the plug is located eccentrically within the housing and the at least one fluid channel is located radially central within the housing.

11. The method of claim 8, wherein the at least one slot includes a first set of slots at a first axial location of the housing and a second set of slots at a second axial location of the housing, wherein the first axial location is closer to the valve than the second axial location, further comprising operating the linear actuator to place the sleeve in another position such that one of: (i) the first set of slots is open, the second set of slots is closed, and the valve is closed; and (ii) the first set of slots is closed, the second set of slots is open and the valve is open; and (iii) the first set of slots is closed, the second set of slots is closed and the valve is open.

12. The method of claim 8, wherein the at least one slots includes a first set of slots and a second set of slots axially displaced from the first set of slots, further comprising operating the linear actuator to place the sleeve at another position such that the at least one opening opens both the first set of slots and the second set of slots.

13. The method of claim 8, further comprising operating the linear actuator to move the sleeve to another position such that one of: (i) the at least one opening partially overlaps the at least one slot; and (ii) the at least one opening fully overlaps the at least one slot.

* * * * *